United States Patent [19]

Winterhalter et al.

[11] Patent Number: 4,691,635

[45] Date of Patent: Sep. 8, 1987

[54] SAFETY FUSE FOR A SPINNING-TYPE PROJECTILE

[75] Inventors: Walter Winterhalter, Tennenbronn; Andreas Halssig, Denkingen, both of Fed. Rep. of Germany

[73] Assignee: Gebruder Junghans GmbH, Schramberg, Fed. Rep. of Germany

[21] Appl. No.: 775,400

[22] Filed: Sep. 12, 1985

[30] Foreign Application Priority Data

Sep. 27, 1984 [DE] Fed. Rep. of Germany ..... 3435402

[51] Int. Cl.[4] ..... F42C 15/26

[52] U.S. Cl. ..... 102/251; 102/254; 102/235

[58] Field of Search ..... 102/235, 236, 251, 244, 102/245, 246, 254, 255, 256

[56] References Cited

U.S. PATENT DOCUMENTS

| | | | |
|---|---|---|---|
| 2,392,430 | 1/1946 | Teitscheid | 102/245 |
| 2,709,962 | 6/1955 | Funk et al. | 102/255 |
| 3,956,991 | 5/1976 | Means et al. | 102/245 |
| 4,006,690 | 2/1977 | Stockman et al. | 102/236 |
| 4,550,661 | 11/1985 | Rehmann | 102/256 |

FOREIGN PATENT DOCUMENTS

| | | | |
|---|---|---|---|
| 1077575 | 3/1960 | Fed. Rep. of Germany | 102/244 |
| 3205153 | 9/1983 | Fed. Rep. of Germany . | |
| 3224749 | 1/1984 | Fed. Rep. of Germany . | |

*Primary Examiner*—Stephen C. Bentley
*Assistant Examiner*—Stephen M. Johnson
*Attorney, Agent, or Firm*—Burns, Doane, Swecker & Mathis

[57] ABSTRACT

A spherical safety rotor of a fuse of a spinning projectile comprises a recess to lock the rotor into its safety position. A retaining chamber for a detonator includes opposing orifices on the spherical surface. Cut-outs are provided in the rotor periphery to reduce the mass of the rotor. The cut-outs are arranged so that no portion thereof overlies a detonating chamber when the rotor is in its safety position.

5 Claims, 5 Drawing Figures

SAFETY FUSE FOR A SPINNING-TYPE PROJECTILE

BACKGROUND AND OBJECTS OF THE INVENTION

The invention concerns a spherical safety rotor of a fuse for a spinning projectile with a recess on the surface of the sphere or ball to lock the rotor in the safety position. An axially continuous retaining chamber of the ball carries the detonating means and has two opposing orifices. A first cut-out in the spherical surface adjacent to the first orifice reduces the mass of the ball.

A safety rotor of this type is described in German Patent DE-OS No. 32 24 749, the disclosure of which is incorporated herein by reference. The cut-out in the ball reduces the mass of the rotor only slightly. In addition, the cut-out is located on the rotor so that when the ball is in the safety position it only partially covers a detonating passage, which detrimentally affects the safety of the fuse. That is, there exists the possibility that communication can occur between the charge in the detonating passage and the detonator in the ball, via the cut-out.

It has been discovered that as the result of unavoidable tolerances, the center of gravity of the rotor is usually off-center. During the rotation of the projectile, the rotor then moves out of the true center in the fuse. Consequently, differential frictional forces occur between the rotor and the surrounding bearing shell of the fuse. Higher frictional forces thus act against the pre-set moment of the rotor which is to impel the rotor from the safety position to the ignition position. Under certain unfavorable conditions these opposing frictional forces may lead to the failure of the rotor.

It is an object of the invention to provide a rotor of the afore-mentioned type wherein the displacement of the rotor from the safety position to the ignition position is facilitated without detrimentally affecting fuse safety.

According to the invention, this object is attained with a rotor of the above-mentioned type by that at least one second cut-out is provided adjacent to the second orifice in the surface of the ball, in order to reduce the mass of the rotor. The reduction in mass of the rotor decreases the frictional forces generated between the rotor and its bearing in the case of untrue rotation. Accordingly, these forces act only slightly against the set-up moment of the rotor, so that the latter is able to become erected safely.

By means of the distribution of the mass-reducing cut-outs of the rotor, a favorable distribution of the surface zones of the ball serving to support it, may be obtained. The cut-outs may be arranged so that the safety functions of the rotor are not affected. It is, therefore, an object of the invention to provide the rotor with mass-reducing cut-outs without reducing the safety of the fuse.

SUMMARY OF THE PREFERRED EMBODIMENTS OF THE INVENTION

In one embodiment of the invention, two cut-outs are provided which surround the orifices. One cut-out is located between one of the orifices and the locking recess and the other cut-out between the other orifice and a covering zone of the spherical surface located diagonally opposite the locking recess. The covering zone, in the safety position of the rotor, overlies a detonating passage of the fuse. The annular cut-outs may be produced simply and result in a significant reduction of the mass of the rotor. They interfere neither with the function of the recess nor of the covering zone. For a further reduction in mass, the two cut-outs are preferably deepended in the shape of channels in the direction of the axis of the through-chamber. If the locking recess tapers conically, then preferably the cross-section of the cut-out near it is adapted to it by having one wall which tapers parallel to the locking recess and another wall that is approximately parallel to the axis of the through-chamber. In order to make the other cut-out as large as possible, it has a U-shaped configuration in cross-section.

By placing the cut-outs close to the through-chamber or its end orifices, the areas cut out to reduce the mass are not those which would strongly affect its torque. To this extent, the rotor has a relatively high torque in rotation.

In another embodiment of the invention, the cut-outs extend only over a portion of the circumference of the rotor and the cut-outs are in opposing locations in relation to the axis of the through-chamber. It is thereby attained, in addition to the reduction in mass, that the rotor is set up during rotation aligned in one plane, i.e., it gyrates only slightly.

It is possible to provide more than two of the aforementioned cut-outs, i.e., 4 or 6 cut-outs. The latter are then arranged symmetrically in relation to the axis of the retaining chamber.

The rotor described above moves following its release rapidly from the safety position into the ignition position. This assures that puncturing detonating agents, which react undesirably to oblique puncturing, will be punctured correctly. If necessary, the rotor may be locked in its igniting position. Such locking means prevent the over-shooting of the rotor past the ignition setting.

BRIEF DESCRIPTION OF THE DRAWING

The objects and advantages of the invention will become apparent from the following detailed description of preferred embodiments thereof in connection with the accompanying drawings in which like numerals designate like elements, and in which.

DETAILED DESCRIPTION OF PREFERRED EMBODIMENTS OF THE INVENTION

Figure 5:
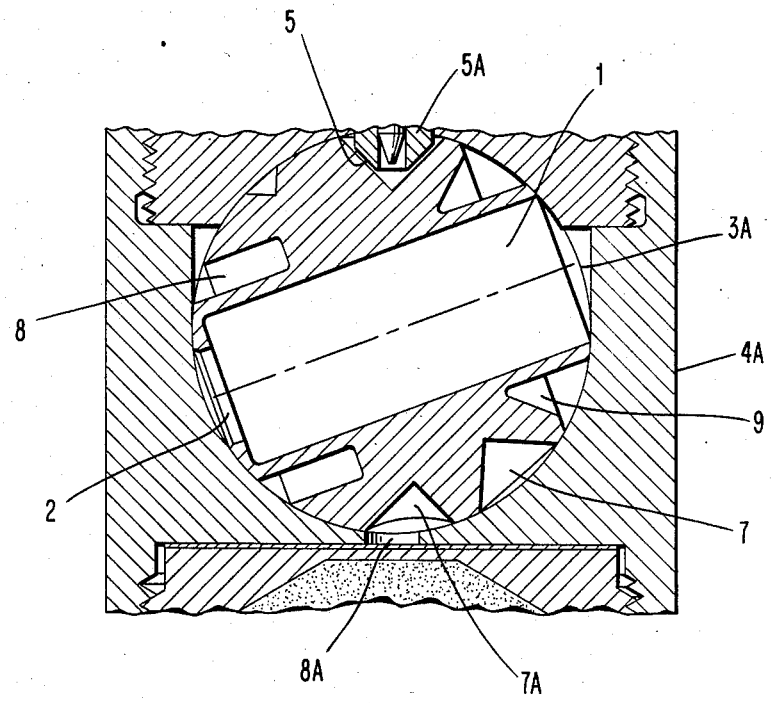
FIG. 5 is a cross-sectional view of the rotor of FIG. 1 in a safety position within a fuse housing.

The spherical safety rotor comprises an axially continuous, essentially cylindrical retaining chamber 1, intended to contain a detonating means (not shown). The retaining chamber 1 defines two end orifices 2 and 3 and its longitudinal axis 4 passes through those orifices. The sphere is rotatably disposed within a spherical cavity 3A in the housing 4A (FIG. 5).

A conically tapering locking recess 5 is molded into a spherical surface. The recess 5 receives a projection 5A to lock the rotor into safety position. The recess is offset in relation to the axis 4. Diagonally opposite to the recess 5, a passage covering portion in the form of a recess 7A is provided. This portion 7A overlies the detonating passage 8A of the fuse when the rotor is in its safety position. Mass-reducing recesses 7 are provided on the surface of the ball.

Figure 1:
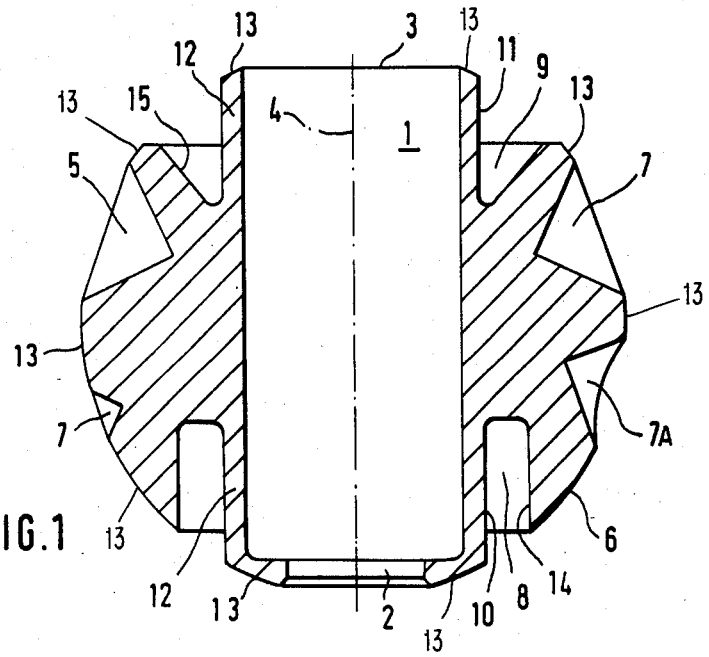
FIG. 1 depicts a safety rotor of a spinning projectile fuse in cross-section.
Figure 2:
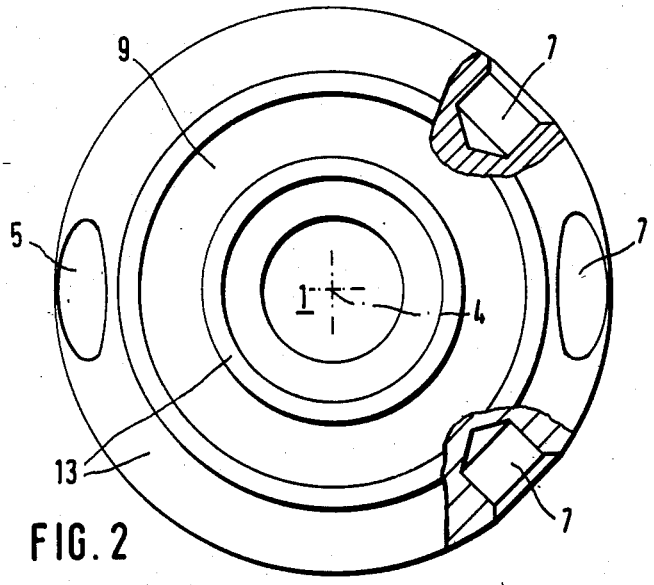
FIG. 2 is a top view of the rotor of FIG. 1.

In the embodiment according to FIGS. 1 and 2, two annular channel-like cut-outs 8 and 9 are provided, which extend concentrically about the axis 4 such that the depth of the cut-outs extends parallel to the axis 4. The cut-out configuration is such that one lateral wall surface 10 and 11 of each cut-out is parallel to the axis 4, with an adequately thick wall 12 remaining between the cut-outs 8 and 9 and the retaining chambers 1. Between the orifices 2,3 and the cut-outs 8,9 and the recesses 5,7 there are bearing surfaces 6,13, upon which the rotor is able to slide in an appropriate spherical bearing shell of the fuse.

The cut-out 8 is U-shaped in its cross-section. Its lateral wall surface 14 opposite the lateral wall surface 10 borders on the bearing surface 6. The cut-out 9 tapers to a point in its cross-section. Its lateral wall surface 15 is approximately parallel to the adjacent chamfer of the conical recess 5.

The volumes of the two cut-outs 8 and 9 are approximately equal. The cut-outs 8 and 9 reduce the mass of the rotor without interfering with its other functions.

It will be appreciated that when the ball is in the safety position as held by the projection 5A disposed in the recess 5, the detonating passage 8A is completely isolated from the cut-out 8 and the orifice 2 by the bearing surface 6, which thus may be considered as an isolating bearing surface which make surface area contact with the cavity and blocks communication between the detonating passage 8A and the detonator disposed within the rotor. The same is true of surface 13. In other words, no portion of either cut-out 8 or 9 surrounding the orifices 2,3 overlies the detonating passage. If desired, the bearing surface 6 could be extended to occupy the region currently occupied by the mass-reducing recess 7A so that the surface 6 covers the detonating passage 8A.

Figure 3:
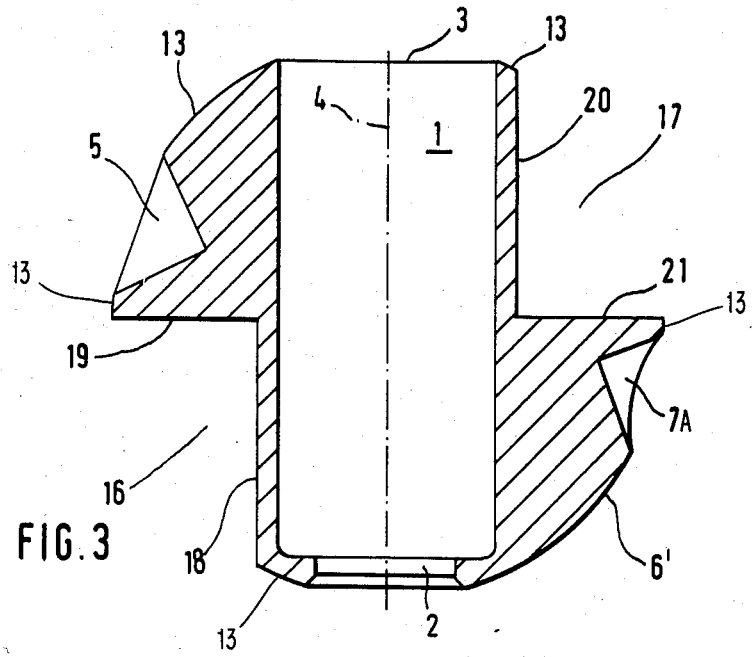
FIG.3 depicts a further embodiment of a safety rotor in cross-section.
Figure 4:
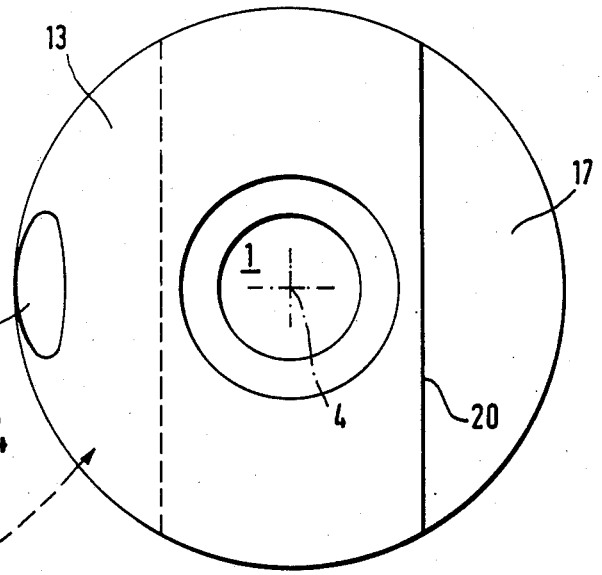
FIG. 4 is a top view of the rotor of FIG. 3.

In a second embodiment according to FIGS. 3 and 4, the rotor comprises two cut-outs 16 and 17 which extend around only a portion of the circumference of the rotor (FIG. 4), i.e., the cut-outs 16 and 17 are not annular. Their two lateral wall surfaces 18,19 and 20,21, respectively, are flat. The cut-outs 16 and 17 are located diagonally opposite each other and on opposite sides of a plane containing the longitudinal axis 4 of the chamber 1. The cut-outs 16,17 lie closely adjacent the respective orifices 2,3. The lateral wall surfaces 19 and 21 are perpendicular to the axis 4. They are located approximately on the equator of the rotor.

By means of the cut-outs 16 and 17, the rotor is set up during rotation in an aligned manner. It then rotates around an axis that is perpendicular to the axis 4 When the rotor is in its safety position, the isolating bearing surface 6' completely isolates the detonating passage from the orifice 2. No portion of either cut-out 16,17 communicates with the orifices 2, 3.

In place of the two cut-outs 16 and 17, six similar cut-outs may be provided, when then are distributed symmetrically around the axis 4.

It will be appreciated that in accordance with the present invention, the provision of cut-outs adjacent both of the orifices 2, 3 enables each cut-out to be configured so that no portion of either overlies the detonating passage.

Although the present invention has been described in connection with the preferred embodiments thereof, it will be appreciated by those skilled in the art that additions, modifications, substitutions, and deletions not specifically described may be made without departing from the spirit and scope of the invention as defined in the appended claims.

What is claimed is:

1. In a safety mechanism for a fuse of a spinning-type projectile, said safety mechanism being of the type comprising a housing having a spherical cavity therein defined by a spherical surface, a spherical rotor rotatably disposed in said spherical cavity, said spherical rotor having a through-chamber therein carrying a detonator, said through-chamber defining a longitudinal axis and including first and second orifices at opposite longitudinal ends thereof, said first and second orifices disposed on a spherical periphery of said spherical rotor in substantially diametrically opposite relationship, said housing including a detonating passage leading to a detonable charge, said spherical rotor including a locking recess engaged by a releasable projection in said housing to lock said spherical rotor in a safety position wherein said first orifice is spaced from said detonating passage in the circumferential direction, said projection disposed diametrically opposite said detonating passage, a first cut-out formed in said spherical rotor periphery adjacent said first orifice to reduce the mass of said spherical rotor, the improvement wherein a second cut-out is provided in said spherical rotor periphery adjacent said second orifice to further reduce the mass of said spherical rotor, said first and second cut-outs being arranged and configured such that no portion thereof overlies said detonating passage when said spherical rotor is in said safety position, each of said first and second cut-outs being annular and extending coaxially relative to said longitudinal axis of said through-chamber, said locking recess disposed between said first an second cut-outs on one side of said spherical rotor, and a passage-covering portion of said spherical rotor periphery being disposed diametrically opposite said locking recess, said passage-covering portion being positioned between said first and second cut-outs and arranged to overlie said detonating passage in said safety position of said rotor, said spherical periphery of said spherical rotor including a first surface area positioned between said passage-covering portion and said first cut-out, and a second surface area positioned between said passage-covering portion and said second cut-out, said first and second surface areas making surface area contact with said spherical surface of said spherical cavity to block communication between said detonating passage and said first and second orifices when said spherical rotor is in said safety position.

2. A safety mechanism according to claim 1, wherein said first and second cut-outs each have a pair of side walls one of said side walls of each pair extending coaxially relative to said longitudinal axis of said through-chamber.

3. A safety mechanism according to claim 2, wherein said second cut-out is V-shaped in cross-section.

4. A safety mechanism according to claim 3, wherein said first cut-out is U-shaped in cross-section.

5. A safety mechanism according to claim 1, wherein said first and second cut-outs are of substantially the same volume.

* * * * *